US008661889B2

(12) United States Patent
Blake

(10) Patent No.: US 8,661,889 B2
(45) Date of Patent: Mar. 4, 2014

(54) AURA DEVICES AND METHODS FOR INCREASING RARE COIN VALUE

(75) Inventor: Duane C. Blake, Westwood, MA (US)

(73) Assignee: Duane C. Blake, Westwood, MA (US)

( * ) Notice: Subject to any disclaimer, the term of this patent is extended or adjusted under 35 U.S.C. 154(b) by 540 days.

(21) Appl. No.: 12/804,141

(22) Filed: Jul. 14, 2010

(65) Prior Publication Data

US 2011/0126618 A1 Jun. 2, 2011

Related U.S. Application Data

(60) Provisional application No. 61/226,263, filed on Jul. 16, 2009.

(51) Int. Cl.
*G07D 5/00* (2006.01)

(52) U.S. Cl.
USPC ..... 73/163

(58) Field of Classification Search
USPC ..... 73/163
See application file for complete search history.

(56) References Cited

U.S. PATENT DOCUMENTS

| | | | | |
|---|---|---|---|---|
| X241 | I1 | 3/1799 | Perkins | |
| 27,140 | A | 2/1860 | Maranville | |
| 1,664,213 | A | 3/1928 | Hoeschen et al. | |
| 3,349,612 | A | 10/1967 | Sherman | |
| 4,058,820 | A | 11/1977 | Hollen | |
| 4,278,353 | A | 7/1981 | Ostermayer, Jr. | |
| 4,309,111 | A * | 1/1982 | Sobresky, Sr. | 356/394 |
| 4,498,771 | A | 2/1985 | Makosch et al. | |
| 4,811,040 | A | 3/1989 | Madsen | |
| 4,878,579 | A | 11/1989 | Hager | |
| 4,899,392 | A * | 2/1990 | Merton | 382/136 |
| 5,011,005 | A * | 4/1991 | Boyd et al. | 206/0.81 |
| 5,033,774 | A | 7/1991 | Benardelli | |
| 5,042,650 | A | 8/1991 | Mayer et al. | |
| 5,103,081 | A | 4/1992 | Fisher et al. | |
| 5,133,019 | A | 7/1992 | Merton et al. | |
| 5,220,614 | A * | 6/1993 | Crain | 382/136 |
| 5,224,176 | A * | 6/1993 | Crain | 382/136 |
| 5,521,984 | A | 5/1996 | Denenberg et al. | |
| 5,911,131 | A | 6/1999 | Vig | |
| 5,966,673 | A | 10/1999 | Shannon, Sr. | |

(Continued)

FOREIGN PATENT DOCUMENTS

| | | | |
|---|---|---|---|
| EP | 0999429 | A1 | 5/2000 |
| WO | 2008055267 | A2 | 5/2008 |

OTHER PUBLICATIONS

NGC "Star" ("*") T.M. Reg. 77606913 (Registered Jun. 16, 2009).

(Continued)

*Primary Examiner* — Andre Allen
(74) *Attorney, Agent, or Firm* — Duane C. Blake

(57) ABSTRACT

The present invention relates to coin value safeguard devices and methods by determining and monitoring the eye appeal of a coin and labeling that eye appeal on an appropriate holder of the coin such that the eye appeal is displayed to a viewer of the holder, and that coin's value is thus increased. Appropriately knowledgeable graders assess a coin's eye appeal by determining the coin's axial ultimate refractory angle(s) (AURA) and assigning an AURA rating to the coin. The coin image is stored in a database where it may be compared to secondary temporal images of the coin as necessary to determine whether coin doctoring has been employed.

5 Claims, 5 Drawing Sheets

©2008 Duane C. Blake

(56) References Cited

U.S. PATENT DOCUMENTS

| | | | | |
|---|---|---|---|---|
| 6,029,807 | A | 2/2000 | Love | |
| D423,757 | S | 4/2000 | Briggs | |
| 6,142,285 | A | 11/2000 | Panzeri et al. | |
| 6,157,450 | A | 12/2000 | Marchese-Ragona et al. | |
| 6,290,130 | B1 | 9/2001 | Drexler | |
| 6,366,899 | B1 * | 4/2002 | Kernz | 1/1 |
| 6,417,471 | B1 | 7/2002 | Rompel | |
| 6,525,829 | B1 | 2/2003 | Powell et al. | |
| 6,634,482 | B1 | 10/2003 | Miele | |
| 6,640,232 | B2 * | 10/2003 | Kernz | 1/1 |
| 6,643,666 | B1 * | 11/2003 | Kernz | 1/1 |
| 6,784,431 | B2 | 8/2004 | Shelley et al. | |
| 7,004,299 | B2 | 2/2006 | Eich et al. | |
| 7,123,357 | B2 | 10/2006 | Meeks | |
| 7,260,544 | B1 | 8/2007 | Reinitz et al. | |
| 7,360,081 | B2 | 4/2008 | Pretorius | |
| D595,924 | S | 7/2009 | Haynes | |
| 7,557,917 | B1 | 7/2009 | Beesley | |
| 7,576,845 | B2 | 8/2009 | Asakura et al. | |
| 7,642,895 | B2 | 1/2010 | Fitzgibbon et al. | |
| 7,663,745 | B2 | 2/2010 | Zaman et al. | |
| 7,743,902 | B2 | 6/2010 | Wendell et al. | |
| 7,834,987 | B2 | 11/2010 | Reinitz et al. | |
| 7,856,137 | B2 | 12/2010 | Yonezawa et al. | |
| 7,876,485 | B2 | 1/2011 | Mochizuki | |
| 7,916,281 | B2 | 3/2011 | Haddock | |
| 2002/0120611 | A1 * | 8/2002 | Kernz | 707/1 |
| 2002/0162756 | A1 * | 11/2002 | Seligman et al. | 206/0.82 |
| 2005/0011772 | A1 | 1/2005 | Eichenbaum | |
| 2005/0016036 | A1 * | 1/2005 | Seligman et al. | 40/27.5 |
| 2005/0036131 | A1 | 2/2005 | Johnson et al. | |
| 2005/0056777 | A1 | 3/2005 | Lee | |
| 2006/0278539 | A1 * | 12/2006 | Fager | 206/0.82 |
| 2007/0005486 | A1 | 1/2007 | Haynes | |
| 2007/0023493 | A1 * | 2/2007 | Higer | 232/1 D |
| 2007/0067178 | A1 | 3/2007 | Reinitz et al. | |
| 2007/0113451 | A1 | 5/2007 | McDowell | |
| 2007/0146691 | A1 | 6/2007 | Zaman et al. | |
| 2008/0023343 | A1 | 1/2008 | Macor | |
| 2008/0023351 | A1 | 1/2008 | Macor | |
| 2008/0149518 | A1 | 6/2008 | Macor | |
| 2009/0048803 | A1 | 2/2009 | Zwieg et al. | |
| 2009/0218401 | A1 | 9/2009 | Moran et al. | |
| 2009/0235733 | A1 | 9/2009 | Hato et al. | |
| 2009/0284754 | A1 | 11/2009 | Haddock | |
| 2009/0286458 | A1 | 11/2009 | Haddock | |
| 2009/0295912 | A1 | 12/2009 | Haddock | |
| 2009/0296365 | A1 | 12/2009 | Haddock | |
| 2010/0039818 | A1 | 2/2010 | Haddock | |
| 2010/0092067 | A1 | 4/2010 | Ellawand | |
| 2010/0220310 | A1 | 9/2010 | Blodgett et al. | |
| 2011/0016965 | A1 | 1/2011 | Sasaki | |
| 2011/0023596 | A1 | 2/2011 | Fortin | |
| 2011/0031139 | A1 | 2/2011 | Macor | |
| 2011/0231645 | A1 | 9/2011 | Thomas et al. | |
| 2011/0238589 | A1 | 9/2011 | Willis et al. | |

OTHER PUBLICATIONS

Salzberg, et al. "News & Views" Jun. 2000 "Eye on Grading" 1 page.

Defendant document filed in the legal matter of *Duane Blake* v. *Professional Coin Grading Service, Numismatic Guaranty Corporation, Collectors Universe, Inc.*, CV-11531-WGY (D. Mass., filed Aug. 31, 2011).

Grynszpan, et al. "Surface topology investigation for ancient coinage assessment using optical interferometry", Appl. Phys. A 79, 273-276 (2004). 4 pages.

Willis, Donald E., Jr. "PCGS Secure Plus" (TM). The Coin Dealer Newsletter, Jun. 11, 2010. 2 pages.

Bassett, Richard A, "A Computer-Based Objective Interactive Numismatic System" (Aug. 2003). ETD Collection for Pace University. Paper AAI3106821. http://digitalcommons.pace.edu/dissertations/AAI3106821 190 pgs.

Halperin, J., "CoinGrading.com". 1999, Heritage Capital Corporation. http://www.coingrading.com/eyeappeal1.html; http://www.coingrading.com/preface1.html 8 pgs.

Flynn, Kevin, Lincoln Cent Matte Proofs, published by Kyle Vick Press (First Ed. 2009), pp. 33-35.

Paparazzo, E., "Organic Substances at Metal Surfaces: Archaeological Evidence and the Elder Pliny's Account," Archaeometry, 615-624, University of Oxford (2003).

NGC's Plus and Stay Designations, http://www.ngcoin.com/coingrading/plus-and-star-designations.aspx, 2 pgs. 2010.

CAC Keeping Strict Standards (2008) http://www.caccoin.com/cac-in-the-news/cac-keeping-strict-standards/2 pgs.

Travers, Scott A. and Danreuther, John W., "The Official Guide to Coin Grading and Counterfeit Detection," New York: House of Collectibles, Second Edition, (1997)., pp. 24, 59.

* cited by examiner

AURA DEVICES AND METHODS FOR INCREASING RARE COIN VALUE

CROSS-REFERENCE TO RELATED APPLICATION

Applicant claims priority and all benefits of U.S. Provisional Patent Application Ser. No. 61/226,263, filed Jul. 16, 2009, which is hereby incorporated by reference in its entirety.

COPYRIGHT NOTICE

Copyright 2008 Duane C. Blake pursuant to 17 U.S.C. §401. All rights reserved.

BACKGROUND OF THE INVENTION

The study and collection of coins and currency has transformed from hobby into profitable industry. The collecting of rare coins in particular has created enormous value, and the market for buying, selling and trading rare coins has significantly expanded in the preceding 100 years. The American Numismatic Association (ANA), a non-profit corporation supporting the rare coin industry, estimated that the total rare coin market experienced domestic sales approximating $2 billion in 2003 alone. This value was spurred by the ongoing development of uniform standards for evaluating or "grading" the physical condition of the coins. The ANA introduced and later updated descriptive terms for grading coins (e.g., Proof, Uncirculated, About Uncirculated, Extremely Fine, Very Fine, Fine, Very Good, Good, Fair, Poor) so dealers and collectors alike could grade the various condition of any given coin. Likewise, Dr. William H. Sheldon created a standardized numerical scale (from 1 to 70), known as the Sheldon Scale, which is now an accepted standard used to add more objectivity to coin grading (e.g. a coin that is graded a '65' on the Sheldon Scale is in a better condition compared to a coin that is graded as a '50'). The basic idea of the Sheldon Scale is that the higher the Sheldon number of a given coin, generally, the greater the value of that coin. While a 100 point grading scale was proposed by numismatist and historian Q. David Bowers, many coin industry insiders rejected the idea, believing that such a system would create confusion and have a detrimental effect on the already-developed industry market. Even with these many positive advancements, however, by the 1970's, the coin market had grown large and chaotic. Coin grading, and thus valuation, which was mostly subjective, varied widely from dealer to dealer, and counterfeit coins were rampant in the marketplace.

Solutions were sought and initiated. The American Numismatic Association Certification Service (ANACS) was created to independently review, authenticate and grade coins for a fee, and this service was tremendously successful. More recently in 1986, the Professional Coin Grading Service (PCGS) was founded, which not only graded and certified coins, but also sealed the coins in tamper-proof plastic holders with interior grading labels displaying the coin and its numeric grade. A year later, another large grading service, the Numismatic Guaranty Corporation (NGC) was started, which performed a service similar to PCGS. The graders of the certification services evaluated coins for the strike, luster and extraneous marks of the coin, and subsequently gave the coin a numeric grade based upon the Sheldon Scale. As mentioned, generally, the higher the numeric grade, the better and, consequently, more valuable the coin. These third-party certification services rapidly became accepted and were extremely popular with the numismatic community, introducing more consistency, transparency, confidence and stability into the coin market. Investors and collectors in the coin market were becoming more confident.

However, as mentioned, while the foregoing certification services graded the "technical" merits of a coin, including a coin's strike, surface condition, luster, and other technical elements of the coin, none of the services adequately addressed the overall appearance/aesthetic attractiveness of a coin, known as the 'eye appeal' of the coin, despite the fact that eye appeal is critical to and often adds significant value to a coin. This omission of the eye appeal recognition on the grading labels has led to wide variance between the value of coins within the same numeric grade, creating instability and uncertainty in the grading system and the coin market.

While the coin industry has made attempts to rectify this serious problem, no larger uniform attempt has been made to devise a novel eye appeal standard. To be fair, certification services have attempted to recognize a 'better' coin within the same grade (e.g. a '65') by building additional grading points into the official numerical grading number. But the level of value added as an eye appeal sub-grade is unclear from the label on the coin's holder. In a further attempt to give credit to a coin's eye appeal, NGC has used a 'star' label system on the plastic holder to credit a coin that has exceedingly beautiful eye appeal as compared to other coins in the same technical grade. Also, on a smaller scale, private dealers also have their particular grading systems to separate great coins from lesser within the same grade: Rick Snow and Brian Wagner (Eagle Eye Photo Seal™), Rick Tomaska ("Everett™" Coin initiative), David Lawrence (multiple star system), have each developed systems to help collectors differentiate the low end, average and extraordinary coins. Most recently, and on a larger scale, the Certified Acceptance Corporation (CAC™) was created and has given the numismatic field a system dedicated to help distinguish between high-end and low-end coins within the same labeled grades. CAC evaluates whether the grade assigned to a coin by a commercial service and has already been placed in a holder or "slabbed" is appropriately graded, in the opinion of CAC. The holders are then either stickered on the outside of the holder to indicate if they are correctly graded (with a green hologram sticker) or over-graded (with a gold hologram sticker) placed on the outside of the coin holder. For some coins, CAC does not place a sticker. This service has been thus far successful, with stickered coins trading for an average of twenty percent premium in the marketplace. Many industry insiders feel, though, that the service's expertise is quite limited to primarily gold coins, and the holder hologram sticker effort is quite accurate in the gold coin series, yet they feel that many non-gold series are not as accurately appraised and graded by CAC (for example, many copper series coins), and this is a shortcoming of the service. Furthermore, CAC does not delineate the specific eye appeal of a given coin, but merely confirms that a technical grade given by the original grading service is high or low.

Others have also contemplated including other information inside of a slab, for example United States Patent Application Publication Number 20070113451, entitled "Collectable Holders" and filed Jun. 30, 2006 teaches "Data about a collectible may include, for example, the collectible's name (e.g., 1884 Morgan Silver Dollar—$1), the collectible's grade (e.g., MS68), the grading company (e.g., ANACS), the date the coin was graded (e.g., Jan. 1, 2005), any type of additional information about the collectible (e.g., the original mintage or print run), the number of collectibles of that same type graded to date (e.g., 103), the number of type of collectibles of that same type graded that same grade (e.g., 10), the specific identification number by the grading company for the collectible (e.g., 345981112), additional specific information by the grading company (e.g., internal category number associated to type of collectible such as 6907.68), and other type of information. Such additional information may include, for example, information that may not be able to be printed on a label because of size concerns. Thus, such information may include an extensive history of the collectible, populations for the collectible in a variety of grades, historic pricing information for the collectible in a variety of grades, information about the encapsulation authority (e.g., ANACS contact information), and information about the components of the holder (e.g., information such as type and version)." Still, to the inventor's knowledge, until the present invention, the element of a coin's eye appeal, as quantified as a labeling element within a formal eye appeal grading system, and recorded within an appropriate holder, has not been adequately accomplished or addressed at this time. Given the fact that so much of a collectable coin's value may be impacted by the eye appeal of the coin, this is a surprising fact that actually teaches away from the present invention described herein.

So the problem in the industry becomes clear: the rare coin grading industry is fragmented, and each service may utilize the same technical numerical grading system, but no coordination exists for the consistant recognition of eye appeal within the industry. While many fine grading services exist, including the aforementioned NGC, PCGS, ANACS, SEGS, IGC and the new Dominion Grading Service (DGS), the problem is that each has its various strong selling points, and each is both weak and strong depending on the various methods they employ, or developments they may have built. But, at the base of the problem, the industry is not coordinated on one of the important elements of true coin value: eye appeal. Not one service offers a truly comprehensive analysis, labeling and monitoring of one of the most important and temporally-transitory elements of coin value: (eye appeal, as mentioned, is directly connected to the monetary value of a coin). Without an accepted and stable system to measure eye appeal, the benefit of trading coins in a 'sight-unseen" manner, much like a stock is traded, is not practical. The confidence in the coin's true value cannot be quantified by the buyer with confidence. So none of the present efforts to incorporate the important factor of eye appeal into the grading of coins has been made objective, transparent or has yet been standardized. In other words, the aforementioned services do not fairly and systematically quantify the eye appeal of a coin, despite the fact that the ultimate value of a coin hinges on both its technical merit AND eye appeal.

Hence, there is a need for a system and mechanism that can objectively and systematically determine and record the eye appeal of a coin and then easily and clearly convey this eye appeal to coin dealers, collectors, and investors with adjustments over time when necessary. This system would allow coins with higher eye appeal to appropriately trade for a premium price over coins with lower eye appeal and promote certainty in the coin marketplace. The present invention offers viable solutions to the enumerated industry challenges, including novel methods to remedy the issues discussed above, and unify the industry in this regard.

SUMMARY OF THE INVENTION

The present invention provides devices and methods for objectively and systematically labeling and monitoring the eye appeal of a coin, and thus increasing purchaser and market certainty, thereby increasing that coin's market value. In one embodiment, the eye appeal of the coin may be evaluated by professional numismatists or those with knowledge in the coin grading arts who determine the axial ultimate refractory angles (AURA) of a coin. A holder of the coin can be labeled with the eye appeal determined and labeled so that the eye appeal rating of the coin is recorded on the coin holder label and visible to anyone viewing the coin. In a further embodiment, the labeled coin can be monitored over a period of time in order to be sure that it maintains the eye appeal rating over time and that has not naturally diminished in eye appeal (known as 'turning in the holder') or been unnaturally tampered with by any number of coin manipulation methods.

Accordingly, the present invention relates to a method of determining and labeling the eye appeal of a coin, the method comprising providing one or more appropriately knowledgeable numismatists or those skilled in the grading arts ('known as graders') and a manner by which to determine the axial ultimate refractory angle of the coin; using the graders in a manner such that the axial ultimate refractory angle of the coin is properly determined; and labeling on an appropriate holder of such coin in a manner such that the axial ultimate refractory angle of the coin is displayed to a viewer of the holder. In one embodiment, the labeling of the coin is performed by including a color-coded label inside of the appropriate holder which indicates the axial ultimate refractory angle of the coin. In another embodiment, the color-coded label inside of the appropriate holder indicates that the axial ultimate refractory angle of the coin is above average, average or below average. In yet another embodiment, the labeling of the coin is performed by including a number on the label inside of the appropriate holder which indicates the axial ultimate refractory angle of the coin using alpha-numeric or keyboard characters, as are defined herein. In further embodiments, the number on the label inside of the appropriate holder that indicates the axial ultimate refractory angle of the coin is a number from 1 to 4, 1 to 10 or 1 to 70. In another embodiment, the one or more graders are knowledgeable about the series to which the coin belongs. In yet another embodiment of the method, the eye appeal of the coin is re-determined after an interval of time and the appropriate holder of the coin is re-labeled with the re-determined axial ultimate refractory angle. In one embodiment, the interval of time is one year, and in another embodiment, the interval of time is every two years.

The present invention also relates to a method for determining the eye appeal of a coin using one or more axial ultimate refractory angles of the coin, the method comprising the steps of visualizing under appropriate illumination one or more axial ultimate refractory angles on the obverse and reverse sides of the coin; evaluating the one or more axial ultimate refractory angles on the obverse and reverse sides of the coin by eye; inspecting the one or more axial ultimate refractory angles on the obverse and reverse sides of the coin under appropriate magnification; and rating the one or more axial ultimate refractory angles on the obverse and reverse sides of the coin, wherein the steps of the method are performed by an appropriately knowledgeable grader. In one embodiment, the appropriately knowledgeable grader visualizes the one or more axial ultimate refractory angles on the obverse side of the coin by holding the coin with the obverse side facing up in a plane parallel to the ground; viewing the obverse side of the coin for an axial ultimate refractory angle; tilting the obverse side of the coin to one or more angles; and viewing the obverse side of the coin at each of the one or more angles to identify one or more axial ultimate refractory angles. Similarly, for the reverse side of the coin, the appropriately knowledgeable grader visualizes the one or more axial ultimate refractory angles on the reverse side of the coin by holding the coin with the reverse side facing up in a plane parallel to the ground; viewing the reverse side of the coin for an axial ultimate refractory angle; tilting the reverse side of the coin to one or more angles; and viewing the reverse side of the coin at each of the one or more angles to identify one or more axial ultimate refractory angles.

In a particular embodiment of the method, the coin is inspected under 5 times, 10 times or 100 times magnification. In another embodiment, the one or more axial ultimate refractory angles on the obverse and reverse sides of the coin are rated on a numeric scale. In yet another embodiment, the numeric scale has a range selected from the group consisting of 1 to 4, 1 to 10 and 1 to 70. In another embodiment, the method further comprises determining an overall axial ultimate refractory angle rating for the coin based on the numeric rating of the one or more axial ultimate refractory angles for the obverse and reverse sides of the coin. In yet another embodiment, the overall axial ultimate refractory angle rating determined for the coin is rated as below average, average or above average. In another embodiment, the overall axial ultimate refractory angle rating determined for the coin is labeled on an appropriate holder of the coin.

The eye appeal of a coin is critical to its value, yet there is currently no way to objectively and consistently quantify a coin's eye appeal or transparently communicate its eye appeal to collectors and dealers. The methods of the invention do just that, providing a mechanism to not only determine the eye appeal of a coin, but also label the holder of the coin with the eye appeal determined. Further, the use of AURA allows the certification services to coordinate and re-grade every single coin they have ever graded, resulting in resurgence of re-slabbing and, as a result, an overhaul of a fractured system. In addition, by re-evaluating the eye appeal of many coins at regular intervals of time, certification services can more easily identify sources of tampered coins, decreasing their liability and insurance costs. In all, the formal assessment and display of the eye appeal of coins adds a crucial aspect to their evaluation and leads to the rewarding of coins having high eye appeal with increased value in the marketplace.

Definitions

As used herein, "coin" is intended to include a piece of metal (e.g., copper, nickel, silver or combinations thereof or alloys) shaped on its surface(s) by being squeezed between two dies. In particular, the metal can be stamped and issued by the authority of a government for use as money or as a collectable. This definition is intended to include medals, tokens, patterns errors and other related conventional uses of the term. Depending on the software program and biometric devices used, the inventor further contemplates the definition to include bullion, jewelry, paper collectables, and antiques.

As used herein, "eye appeal" refers to the overall appearance and/or aesthetic attractiveness/beauty of a coin with respect to toning, color, balance, freshness, marks/blemishes, strike, luster, planchet condition and surface preservation on both the obverse, reverse and sides of a coin, or any angle thereof. For instance, a coin having high eye appeal generally has vibrant/intense color, excellent toning and/or superior luster. Eye appeal may also refer to level of device/field cameo contrast or proof-like mirror finishes relating to certain coins, or a combination of any of the above (e.g. color and contrast).

As used herein, "appropriately knowledgeable numismatist" or "appropriately knowledgeable graders" is intended to include one or more coin grading professionals (e.g., certification company numistmatists), coin experts, coin graders, or other coin professionals who have, over time, gained significant experience in evaluating and grading coins, including coins of a particular type or series.

As used herein, "Axial Ultimate Refractory Angle" (AURA) is intended to include systems, methods, experienced reviewers, tools and other items that allow a qualitative visualizing, assessing, reviewing, recording of the eye appeal of a coin (see, e.g., Scott A. Travers and John W. Dannreuther, *The Official Guide to Coin Grading and Counterfeit Detection*, New York: House of Collectibles, Second Edition, 1997; incorporated herein by reference). This definition includes, but is not necessarily limited to, the recordation of the assessment in a tangible qualitative or quantitative manner. Included in this definition is the use of computer hardware and software to assist in the grading assessment. For one example contemplated by the present invention, the reader is directed to U.S. Pat. No. 4,899,392 by Henry Merton, issued Feb. 6, 1990, and to be herein incorporated by reference in its entirety. Furthermore, a common commercial off-the-rack software program like Adobe Photoshop® which can be loaded on any conventional computer system, and employed for the coin comparison component, is also contemplated. One of skill in the art can easily adapt this software method, and use for the comparison for same or multi-coin coin surface comparisons, including the obverse, reverse and the edges of the coins.

As used herein, an "overall axial ultimate refractory angle rating" refers to the overall AURA rating given to a coin based on the individual AURA determined for the obverse side and the reverse side of the coin. The calculation of the overall AURA of a coin will depend on the type, condition and technical grade of the coin. The AURA calculation can be balanced, or weighted to allow a particular face (e.g., obverse, reverse) to have more influence in the overall AURA rating.

As used herein, "axial" is intended to include the manipulation/movement of a coin upon its rotation/tilt in space relative to a three-dimensional orthogonal axis (e.g., x-y-z axis).

As used herein, an "ultimate" angle(s) is intended to include the best angle(s) or 'sweet spot(s)' at which to view a particular coin. That is, when a coin is rotated or tilted to an ultimate angle, it displays its greatest eye appeal based on characteristics of eye appeal specific to the type of coin.

As used herein, "refractory" is intended to refer to the ability of the metal of a slabbed or unslabbed coin to act as millions of reflective 'micro mirrors' and abundantly reflect light, thereby making the coin aesthetically pleasing and may be read and recorded as an image by a reflector, light collection device, or image recording device, coupled with a computer source. Any lighting or multi-lighting system as understood by one of skill in the art may be employed.

One of skill in the art readily understands that a commercial image recording device may record images in at least one (or perhaps both) of the infrared (IR) spectrum or the ultraviolet (UV) spectrum.

As used herein, the "angle" of a coin is intended to include the location of the coin in any x-y-z position and/or plane in three-dimensional space in order to determine the ultimate or best view of the coin. There can be one or several such angles at which the coin has an appealing view.

As used herein, "determining" the eye appeal of a coin refers to analysis of the overall appearance of the coin and is meant to include, as applicable to a particular type of coin, assessment of a combination of a coin's characteristics (e.g., luster, strike, toning, color, marks, planchet, and preservation). The "determined eye appeal" or AURA rating of a coin refers to the quantitative numeric (e.g., grade, AURA) or qualitative designation assigned to a coin by one or more appropriately knowledgeable graders that has assessed the eye appeal of the coin. The grader may be on-site or off-site. The grader may be an employee of a grading service or a subcontractor contacted to share their experience regarding the eye appeal of the particular coin. The grading may be accomplished by one solo grader on a consensus of 1000 or more graders, as in a case of the vote on the eye appeal of the particular coin in question. In another embodiment, the grader may be a software program or other computer mechanical means used to discern various elements of the coin grade or eye appeal. The grader, in other circumstances, may be a combination of human and machine working in conjunction a manner by which to properly determined the axial ultimate refractory angle of the coin, labeling on a holder of such coin in a manner such that said axial ultimate refractory angle rating of said coin is displayed to a viewer of said holder, and, over an interval of time, assuring that the maintaining or recording of the eye appeal of the coin is facilitated or monitored. For example, one skilled will recognize that other imaging devices, programs, lighting, or techniques may be employed. For example, a particular application of coin imaging devices may not need to use the entire visible spectrum or all coin angles to determine the AURA. In certain applications, using infra-red, ultraviolet or light scattering imaging methods may be more useful to identify a specific aspect of a unique coin signature or specific area. Computer algorithm known in the art may be used to reduce the imaging data into a single identification computer file. The file may then be stored in any appropriate database.

As used herein, "holding" the coin is intended to include the grasping (gripping, clasping, touching) of the coin itself or a coin in a holder (container, encasement, setting, protector) by one of skill in the art using his or her hand(s). It is also intended to encompass location of the coin on/in an object or device (e.g., table, microscope, and machine) that allows manipulation of the coin such that characteristics of the coin can be identified and evaluated by the skilled artisan.

As used herein, "evaluating" a coin "by eye" is intended to include the ability of a skilled artisan to look at a coin and assess the characteristics of the coin with no more than his or her own corrected (e.g., with glasses, contacts) or uncorrected vision, that is, without any additional magnification. This evaluation is intended to comprise computer assessment or assistance or storage methods, as well.

As used herein, "visualizing under appropriate illumination" is intended to include the ability of one of skill in the art to see or view a coin under a source of light that enables him or her to adequately or best evaluate the axial ultimate refractory angle(s) of the coin.

As used herein, "appropriate magnification" is intended to include visualization of a coin by a skilled artisan using a device, tool (e.g., a loop) or piece of equipment (e.g., a microscope) that magnifies the view of the coin to a level such that the characteristics important to a particular type or series of coin can be identified. For example, the 1879 Proof Flowing Hair Stella or four-dollar obverse view has parallel hairlines horizontally across the face due to roller marks, a definitive characteristic of that type of coin that enhances its eye appeal and value. The coin has to be viewed under appropriate magnification (e.g., 5× magnifications) in order to see and possibly identify these unique marks. Further, using mechanical optical instruments, like a laser or other light refraction and recording source, AURA readings from a plurality of optically detected points on the coin may be obtained and processed into a unique value to produce a unique AURA identifier for a coin. That unique AURA identifier can be loaded and used via a searchable computer database, and retrieved and compared with other image identifiers as desired.

As used herein, an "appropriate holder" is intended to include any holder of a coin and a slab that encapsulates a coin in such a way as to prevent tampering and environmental damage and that can display information about the coin (e.g., grade), generally on a label embedded in the interior or also quantified using exterior labeling in addition to labeling on the interior of the holder. The encasement is typically, but not limited to, a clear, sonically welded plastic of rectangular shape.

As used herein "labeling" a coin is intended to include indicating at some place on or with a coin holder, including: anywhere on the outside or inside of the holder itself (e.g., the front, back or sides of an encasement), on any interior or exterior materials given or stored in conjunction with the coin and holder (e.g., internal/external paper/plastic coin display/support) or on an interior label of the coin holder, information about the coin (e.g., technical grade, AURA rating, coin type, coin date, serial number, hologram, date slabbed). The manner of labeling is intended to include placing another material (e.g., a sticker), characters (e.g., alphanumeric, roman, Arabic, Chinese, etc.), symbols (e.g., QWERTY symbols [i.e. typewriter or computed keyboard symbols] text, pictures, art) and colors at any place on/inside of a coin holder (so long as view of the coin itself is not obscured). This includes labeling that is embedded in or part of the coin holder itself (e.g., a colored or etched coin holder or alpha-numeric or symbolistic grade). As used herein, the "label" is intended to include any section on the outside of a coin holder or any material embedded, attached or placed with the exterior of a coin holder or used in conjunction with the coin and holder which has any color, hue or shade on the section or material or other written, visual or other sensory information that indicates/conveys information about the coin (e.g., AURA rating or coin description). The label may include other information regarding the grade, condition or eye appeal, pedigree, price, or history of the coin. Also contemplated are labels that are computer and bar coded, and contain any information related to the coin that may be relevant to the coin's value, condition or history. This barcode may be linked to the database which can be searched to confirm the date on which the referenced coin was graded and whether it is the same identical coin presently being re-graded, and whether the coin has been fraudulently altered (doctored) in some way.

As used herein, "color-coded label" is intended to include any section on the inside or outside of a coin holder or any material embedded, attached or placed on the interior or exterior of a coin holder or used in conjunction with the coin and holder which has any color, hue or shade on the section or material or other written, visual or other sensory information that indicates/conveys information about the coin (e.g., AURA rating). The color or other information can cover uniformly, cover some portion of, or be interspersed among other colors, spaces or openings on the label/section.

As used herein, "coin doctoring" or "coin tampering" as understood by those of skill in the art, refers to the alteration of the metal of a coin, other than to remove a light topical coating, in order to enhance the coin's appearance and increase its value. Simple dipping to remove, for example, a light covering of grime or PVC (polyvinyl chloride) on a coin's surface, is not coin doctoring. Generally, the intent of coin doctoring is to mislead others and perpetrate a fraud to increase a coin's grade and/or value and obtain a high/higher price for the coin. Coin doctoring can include, for example, among other things, adding substances to coins (e.g., color, smoke, grease, putty, wax, facial oils, petroleum jelly or varnish); treating coins with chemicals (e.g., potash, sulfur, cyanide, iodine or bleach); heat treating coins in any way to alter their appearance; re-matting and/or "skinning" proof gold; "tapping" and "spooning" (i.e., physically moving surface metal to hide marks); filing rim nicks; or repairing coins (re-tooling metal).

BRIEF DESCRIPTION OF THE DRAWINGS

FIG. 2A depicts a front view of the holder label (51), and FIG. 2B, depicts a back view of the holder label (51), and may indicate/convey and display an above-average coin. FIG. 2A, for example of one embodiment, indicates to the viewer by using a color-coded label (51) with blue shading (as stippled in the FIG. 2A (51)) printed on the internal clear display holder (10) that the coin inside of holder (10) has been imaged during the grading process and said image file has been stored for future comparative purposes, and further uses a QWERTY, symbol on the same label (51) (in this case, a plus "+" symbol as the indicator) to further indicate the coin's above-average condition as relating to the partial eye appeal of the coin (the label in practice may further comprise and use other symbols to convey other information)—the color coding and symbols are contemplated to be used in conjunction, and not limited in what information they may convey; FIG. 2C depicts the front view of the holder label (53), and FIG. 2D depicts the back view of the holder label (53), and in this embodiment may indicate/convey and display an average coin, for example (as indicated in this example with off-white/silver label shading, seen here as stippled in FIG. 2C (53)), and/or no QWERTY symbol in this embodiment to indicate the coin's average condition and/or other information). FIG. 2E depicts the front view of the holder label (55), and in this embodiment, further uses a QWERTY symbol on the same label (55) (in this case, a plus "–" symbol) to indicate a below-average coin based on the partial eye appeal of the coin, and FIG. 2F depicts the back view of the holder label (55), and in this embodiment may indicate/convey and display a below-average coin (that may here for example be indicated with red label shading—as stippled in FIG. 2E (55) and/or a QWERTY symbol recorded on or within the label to indicate that coin's below-average condition and/or other information about the coin, such as coin description, and/or any other information regarding the grade, condition, eye appeal, pedigree, price, and/or history of the coin within the display holder (10).

DETAILED DESCRIPTION OF THE INVENTION

Figure 1B:
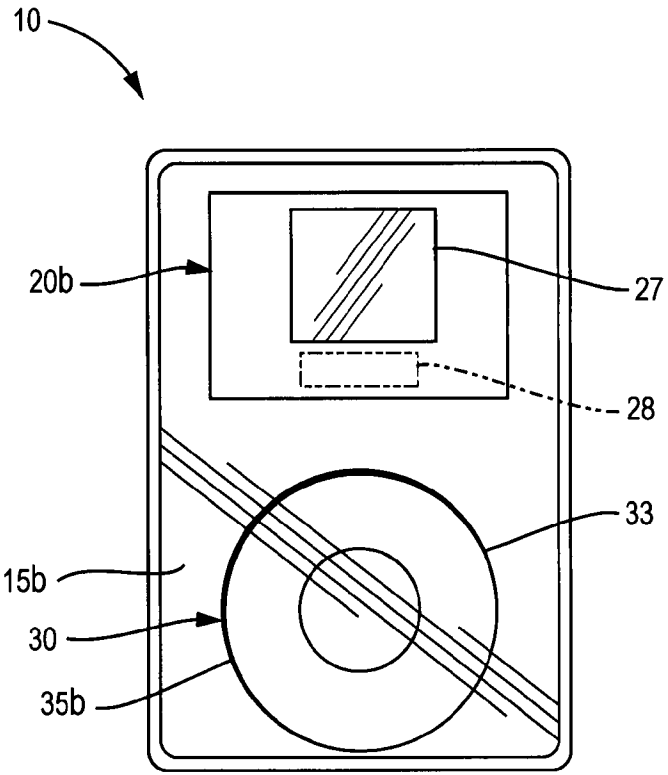
FIG. 1A and FIG. 1B are drawings that illustrate embodiments of the front (FIG. 1A) and back (FIG. 1B) sides of a coin holder that may contain a graded coin within which is clearly displayed, along with a recordation and display of other relevant information, including, for example, in FIG. 1A, an AURA rating (25) for a particular coin located within coin holder 10 in FIG. 1A. The AURA rating may be indicated by recording the AURA rating (25) in FIG. 1A on the front label (20*a*), and employing an appropriate AURA rating designator. One non-limiting exemplary embodiment of an appropriate AURA rating designator is that of a QWERTY plus ("+") symbol which indicates an above-average designation for the condition of a particular associated coin located within holder (10).

The present invention generally relates to methods for objectively assessing the eye appeal of a coin by determining one or more axial ultimate refractory angles (AURAs) of a coin and labeling a holder of said coin such a way that its AURA representation is displayed (via number, color or in other ways contemplated herein). Accordingly, coin collectors can re-submit already slabbed coin to a certification company (e.g., PCGS, NGC, ANACS) for re-grading of the coin for eye appeal, ultimately adding clarity and facilitating sight-unseen transactions in the coin market and value to numerous coins.

The evaluation of the eye appeal and axial refractory angle of a coin is performed by appropriately knowledgeable numistmatists (e.g., coin grading professionals). A manner by which these graders can determine the axial ultimate refractory angle of the coin involves numerous techniques (e.g., by eye/hand, by machine), variables (e.g., light source, magnification) and approaches, (e.g., split grading, technical grading, market grading) that are well-known in the art (see, e.g., Scott A. Travers and John W. Dannreuther, *The Official Guide to Coin Grading and Counterfeit Detection*, New York: House of Collectibles, Second Edition, 1997). The appropriately knowledgeable graders are experienced coin graders, typically, but not always working at certification companies, with extensive understanding and judgment of coin appearance in general and, in many cases, expertise on specific types or series of coins, in particular. Graders or those of skill in the relevant arts may also use, in whole or in part, computer programs or machine systems to facilitate evaluation.

The graders are used in a manner such that the axial ultimate refractory angle is properly determined. Thus, using any approaches and/or techniques known in the art as discussed above, appropriately knowledgeable graders are able to determine the Axial Ultimate Refractory Angle or, AURA, of a coin. The AURA of a coin relates to the concept that all coins have an inherent level of surface reflectivity and/or reflective capacity, and that each coin has a special angle at which it can be viewed that exhibits the maximum effect of this reflectivity. The best AURA(s) allows for the best or better viewing of the color, toning, diagnostics, damage, perfection and other important aspects of the coin (e.g., strike, luster, planchet). The skilled artisan can view the coin under a light source (e.g., lamp, overhead light) that allows for appropriate illumination (e.g., a 60 watt incandescent bulb) of the coin through its reflection of the light source, such that a grader can thoroughly evaluate the characteristics of the coin by eye. Specifically, a grader can determine a coin's AURA by holding the coin (or its holder) in his or her hand and axially tilting (e.g., rotating, moving, swiveling, turning) each side (obverse, reverse) of the coin to many angles in space and, by simply looking at the coin at each of these angles, determine the best viewing angle(s) for each side of the coin. Accordingly, the skill, experience and eye of the appropriately knowledgeable graders are essential to identifying the AURA of a coin; there is currently nothing as effective as the skilled human eye. In addition to evaluating the coin by eye, the graders can also inspect the coin more closely by viewing the coin with a device (e.g., microscope) or tool (e.g., hand-held loop) that magnifies the details of the coin. Any magnification (e.g., 5×, 10×, 100×, 250×, 500×) can be used to view a coin; however, the crucial aspect to selecting the appropriate magnification is that the magnification be high enough to identify defining details that characterize a particular type of coin and/or type of metal comprising the coin.

The best viewing angle(s) of a coin depends on what aspect of the coin one is looking to find, and this aspect is often influenced by the type of metal(s) the coin is composed of. For instance, in copper coins, one generally looks at the planchet, strike, luster and color; in nickel coins, the luster, toning, strike, planchet and marks; in silver coins the marks/hairlines, luster, toning and strike and in gold coins, the marks/hairlines and intensity of color. Indeed, there are some coins that have their best AURA when viewed straight on (e.g., Brilliant coins). Although the AURA method works for any coin, it is easily demonstrated by a Matte Proof Lincoln Cent (MPL), for example. Hence, a MPL is a regular-looking coin when viewed straight on (e.g., parallel to the viewer's field of vision); however, when turned/tilted 45 degrees in a given direction, it can exhibit extraordinary color and luster. Thus, the MPL would have an AURA at 45 degrees. There can be one AURA, or several AURAs for a particular coin and its AURA can be assessed on both the obverse and reverse sides of the coin.

After determining the AURA(s) for a coin, the graders can assign a particular AURA rating accordingly. This rating can be quantitative, based on, for example, a numeric scale, or the rating can be qualitative, based on descriptors associated with distinct levels of eye appeal. A numeric scale can be a range of any numbers deemed appropriate by one of skill in the art, including, for example, scales from: 1 to 70 (like the Sheldon Scale), with the lowest eye appeal coin at AURA 1 and the highest eye appeal coin at AURA 70; however, any range of numbers can be used (e.g., 1 to 4, 1 to 8, 1 to 15, etc.). A grader can determine an AURA rating for an entire coin simply by evaluating the AURA(s) of the obverse and reverse of the coin and assigning an overall AURA rating to the coin. Alternatively, a grader can determine separate or 'split' AURA ratings for the obverse and reverse of the coin, then combine those two ratings in a manner that results in an overall AURA rating for the coin (e.g., using a balanced average or a weighted average). For example, the AURA rating for the obverse of a coin can, for instance, account for one-third of the overall AURA rating, while the AURA rating for the reverse of the coin can account for the remaining two-thirds. The determination of whether a split AURA rating for a coin is warranted is dependent on the particular coin and/or its condition and is a decision best made by the skilled grader on a case-case basis. Further, the calculation of an overall AURA rating for a coin will also vary from coin to coin and the determination of how best to calculate an overall AURA rating is also best left to one of skill in the art.

Alternatively, or in addition, the AURA of a coin can be described by different qualitative designations like, for instance, below average, average or above average. The aforementioned terms that can be used to describe a coin's AURA are well understood in the art, with the skilled artisan well able to identify coins that, based on their AURA(s), fall into those categories. One of skill in the art can also create other and/or additional descriptive terms appropriate to describe the AURA of a coin. A numeric scale can be used within each of the descriptive designations for further clarification of a coin's eye appeal. For instance, coins that fall into the 'below average' category can be given an AURA rating from, e.g., 1 to 70, as can coins that fall into the 'average' and 'above average' categories.

Figure 1A:
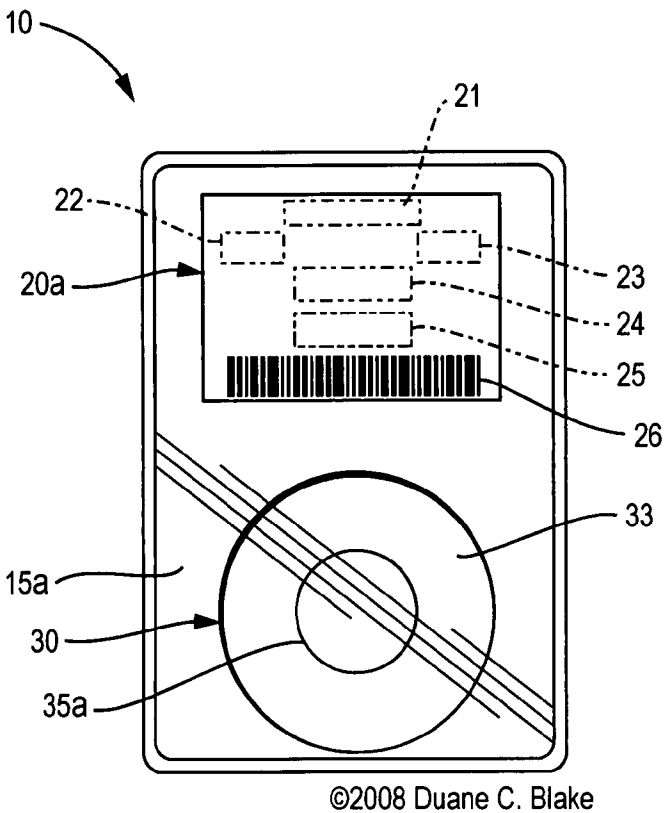

Once the AURA of a coin has been determined and the coin has been given an AURA rating (numeric and/or descriptive), an appropriate holder of the coin can be labeled in a manner such that the AURA rating of the coin is displayed to anyone that views the coin. There are numerous ways in which the AURA rating of a coin can be displayed on the coin holder. For instance, if the AURA rating is conveyed via a numeric scale, this can be displayed on a coin holder as shown in FIG. 1. In FIG. 1, coin holder 10 has a front face 15*a* in which interior embedded front label 20A is displayed. Printed on embedded label 20A, is certification company name 21 (e.g., PCGS, NGC, ANACS), coin year 22 (e.g., 1912), coin denomination 23 (e.g., 1 cent (1 C), 5 cents (5 C), 10 cents (10 C), etc.), technical grade 24 (e.g., Mint State-64 (MS64)) and AURA rating 25 (e.g., AURA 3, AURA 66). Coin diameter 30 has a differential space 33 that is able to secure any size coin in the holder, displaying obverse view 35*a* of the coin on front face 15A of holder 10. Turning to back face 15B of coin holder 10, interior embedded label 20B displays certification company-specific hologram 27 and date of slabbing or re-slabbing 28 after the coin has been evaluated for its AURA. Alternatively, a descriptive AURA rating that is assigned to a coin can be delineated by different color interior labels that are in the coin holder. For instance, a coin that has an above average eye appeal rating can have an interior label of a particular color that indicates the rating, while a coin with a below average eye appeal rating can have an interior label of a different color that indicates that rating. A certification company may use any number of colors, hues or shades to represent different AURA ratings. Along these lines, the present invention further contemplates digitally assigning colors (e.g. RD, RB, BN) and relating the specific colors to numbers corresponding to the pixels relating to the color image of a subject coin image, and then utilizing computer programming knowledge in the arts to 'read' the color image and calculate the color and percentage of color coverage for the entire coin surface and thereafter assign an official color designation to the subject coin. Furthermore, from the recordation of that data, future images of the same coin can be made and compared to indicate whether the subject coin is changing colors in the holder.

Figure 2B:
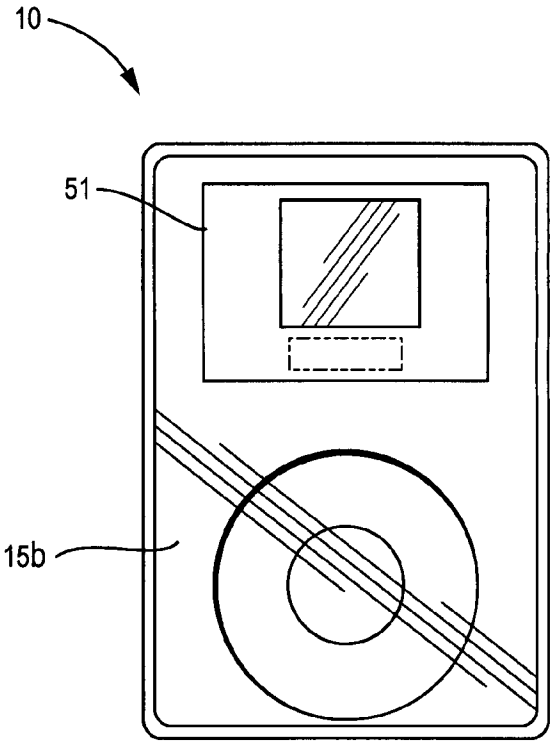
FIG. 2A through FIG. 2F are drawings which further illustrate contemplated embodiments of the front and back labels of coin holders (10) that are contemplated to contain various QWERTY or other colored symbols, and/or color-coded interior labels, as displayed through stippled patterns in FIG. 2A (51), FIG. 2C (53), and FIG. 2E (55), which may indicate/convey and display an AURA rating designation or other pertinent description and/or information relating to the coin inside the holder (10), such as a coin description, and/or any other information regarding the grade, condition, eye appeal, pedigree, price, and/or history of the coin within the display holder (10). For exemplary purposes, the labels (51, 53, 55) may use color, coding and/or other color symbols in conjunction to indicate the AURA rating or coin, description, and/or any other information regarding the grade, condition, eye appeal, pedigree, price, and/or history of the coin within the display holder (10).
Figure 2A:
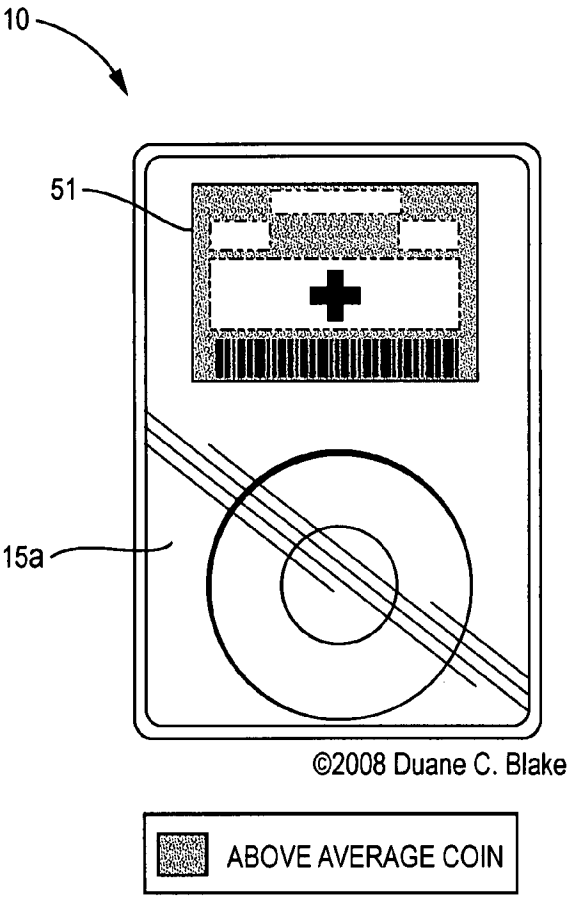
Figure 2D:
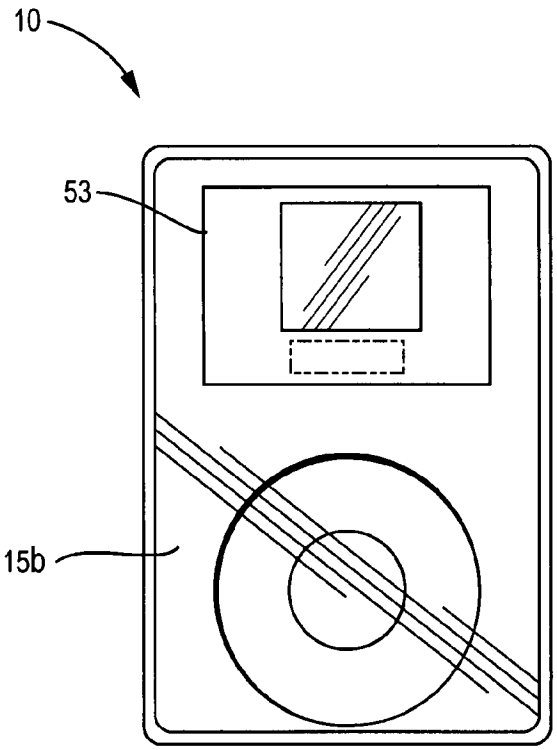
Figure 2C:
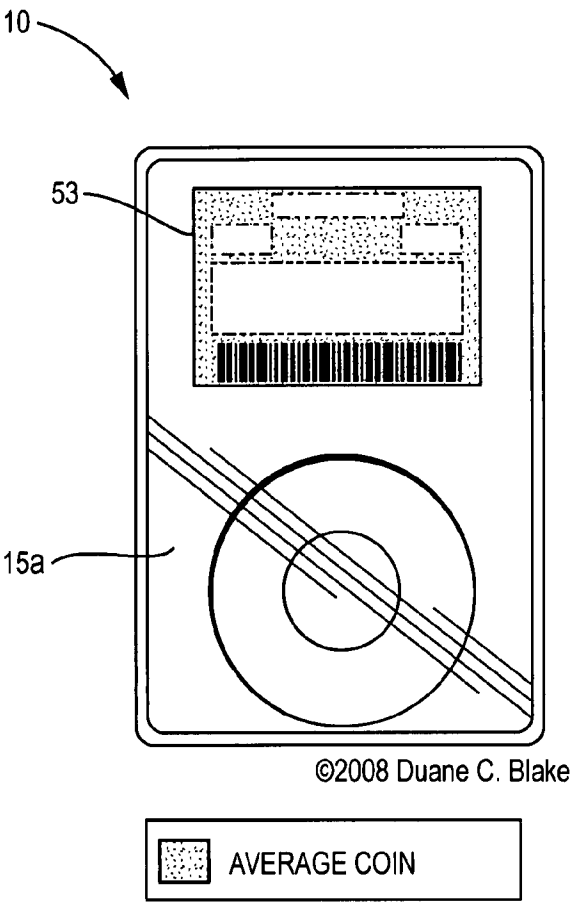
Figure 2F:
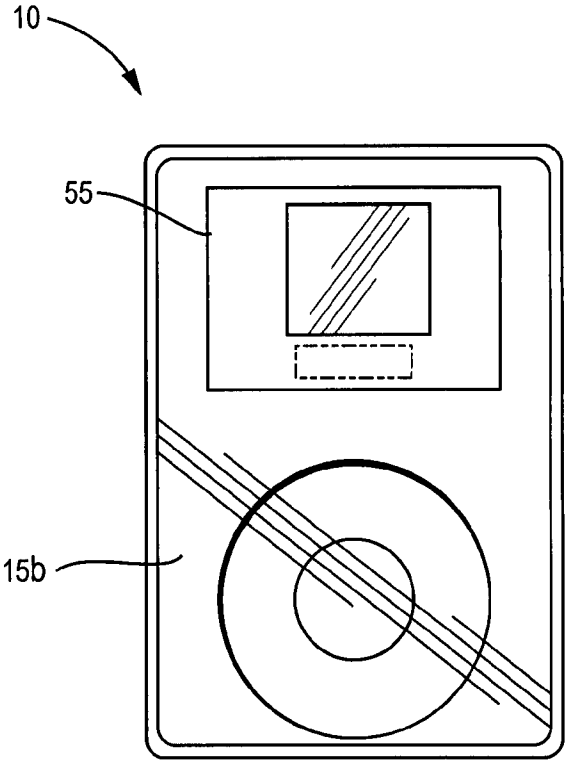
Figure 2E:
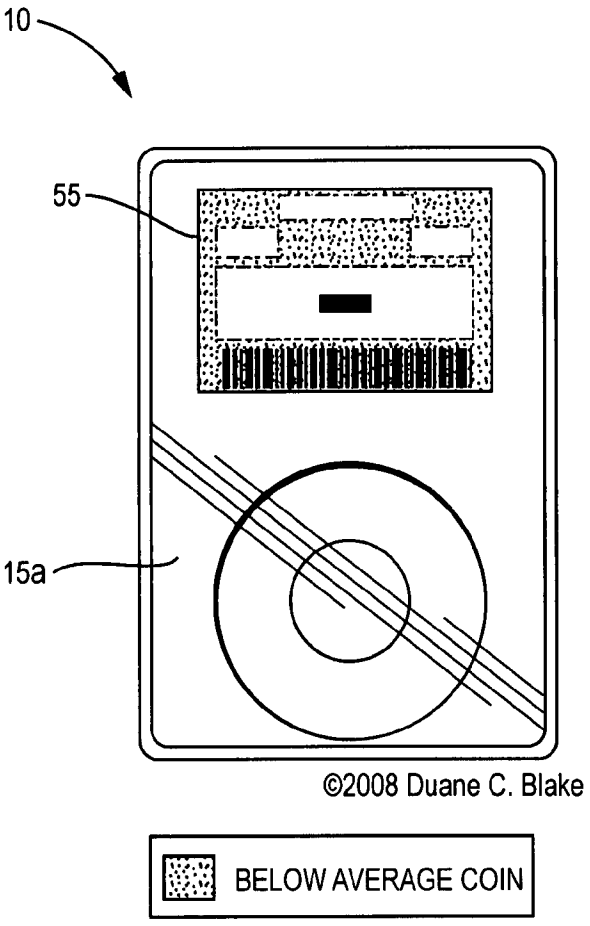

In FIG. 2A, blue interior label 51 indicates that the coin within coin holder (10) may have an above average eye appeal within the grade, and appropriately labeled to convey this above-average condition, while in FIG. 2C, silver interior label 53 indicates that this same coin type that may have an average eye appeal within the grade, and in FIG. 2E, red interior label 55 indicates that this same coin type may have below average eye appeal within its grade. Note that the stippling keys under FIGS. 2A, 2C and 2E are displayed using different and appropriate stippling patterns, which indicate different colors, or possibly symbols'to indicate any varying level of coin condition. The embodiments taught within FIGS. 2A, 2C and 2E are exemplary only. It is contemplated that each embodiment may or may not be used in conjunction with any other. For example, the addition of a QWERTY symbol ("+") sign on interior label 51 in FIG. 2A to indicate an above average coin specimen may be used without the accompanying, and opposite, QWERTY minus ("−") symbol on interior label 55 in FIG. 2E which might indicate a below average coin. The embodiments taught in FIGS. 2A, 2C or 2E are intended to be discrete, and one of skill in the relevant art would understand that the particular condition designators, like numbers, symbols or colors, may be assorted, used and displayed in innumerable ways, and may stand on their own as specific designators of coin condition.

Figure 3B:
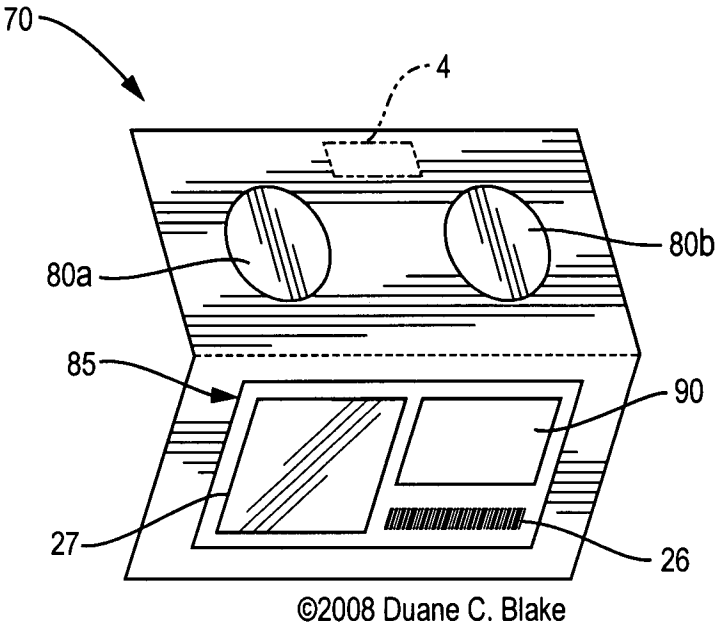
FIG. 3A and FIG. 3B are multiple perspective drawings that graphically exemplify embodiments of an alternative coin holder, which allows for the presentation of a graded coin, a photograph of that coin, comparative photographs, and may also include identifying coin barcode information, computer files relating to such coin, the coin's grade, related and known transactions, any AURA rating designator related to the coin, and alternative additional space being employed in which relevant attributes of the graded coin may be further described (i.e. pedigree, historical data, market conditions, insurance information, value of the coin as a securitizable asset, present owner or holder, etc.
Figure 3A:
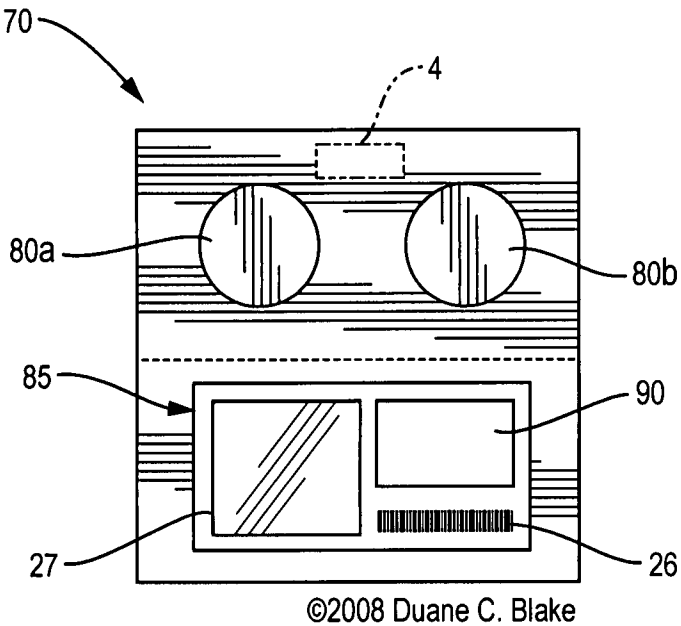

In addition to displaying the determined AURA rating on a coin's holder, this alternative holder embodiment allows the AURA rating to be displayed in conjunction with other relevant data or information about the coin. The data or information may be recorded on this coin holder embodiment, and coupled with a photo image or computer file of that coin. This alternative holder embodiment may be prepared by the grading company. FIG. 3 exemplifies such an embodiment. Alternative holder 70 can be viewed with certification company name 4 and a photograph of the coin's obverse 80A and coin reverse 80B views. Alternative holder 70 has a foldable lower flap separated by perforation from the top portion of the alternative holder 70, which may have a label 85 containing serial barcode 26 and hologram 27 (as shown also on coin holder 10 in FIG. 1A and 1B), and notation area 90, which can display many types of information, including but not limited to the coin's technical grade, AURA rating, particularly attractive eye appeal angles, or any other interesting or distinguishing characteristics of the coin. The coin's photograph may be sent from the grading company back to the coin submitter as a separate product apart from the actual slabbed coin, or the slabbed coin may be attached within the alternative holder 70, this time with the alternative holder 70 serving as a secondary holder, which would allow the graded coin to be inserted within, and along with all of the pertinent information relating to coin, and be transported together with the coin. Alternative holder 70 embodiment is contemplated by the inventor as an aid to storage or display, as well as allowing the coin owner to insure his graded coin based on not only the coin, but valuable external information related to the coin.

Pedigree and AURA rating would be non-limiting examples of external information embodiments which may increase the value of the coin. The alternative holder 70 embodiment might allow for efficient sight-unseen trading, and further allow the product to be sold and or traded much like a stock or other valuable certificate-based asset.

Documentation of a coin's appearance is important, as a coin's eye appeal can change over a period of time. This change can happen naturally due to the reactive nature of the metal the coins are composed of with elements in the coin's environment (e.g., corrosion, oxidation). Although some of these reactive changes to the coin are damaging (e.g., changes due to salt-water, PVC), the reaction process also accounts for many of the spectacular changes to original coins that give them high eye appeal (e.g., color, toning) and increased value. Since natural elements can eventually ruin a coin's appearance, certification companies have created coin holders (e.g., slabs) as a means to both display a coin and protect it from environmental damage.

However, the eye appeal of a coin can also change unnaturally and/or artificially. It is understood by those in the art that these unnatural changes to a coin's appearance are typically the by-product of "coin doctoring", which is incentivized by the higher prices obtained for coins with outstanding eye appeal. There are numerous ways by which a coin can be doctored. For example, a coin doctor can chemically treat a coin to achieve artificial toning, for instance. Still, at some point, the chemical reaction needs to be stopped and, to accomplish this, certain chemical reaction neutralizing agents or 'stoppers' are often added. However, if the reaction is not stopped or the attempt to do so is not completely successful, a graded and slabbed coin, even while inside a sealed plastic holder, can continue to oxidize, destroying the coin's eye appeal and, most likely, ruining the coin and it's original value. The determination of AURA, though, can be used as part of a coin preservation safeguard system by certification companies. Thus, the preservation safeguard system involves an initial evaluation/re-evaluation of a coin for its AURA and securing of that AURA. After the evaluation and assignment of an AURA rating to the coin, a high-grade/quality digital photograph or video recording of the coin's obverse and reverse views can be taken and the images along with other pertinent information (e.g., identity of the coin's owner and/or submitter), maintained in an electronic database by one or more grading services. (e.g., any digital, optical, or other storage systems known in the art including hard drives and hard drive arrays, CD-ROM or DVD discs, intra-company or external computer networks, etc.) that allows subsequent searching and retrieval of the image. The inventor contemplates that a coin specimen may be imaged by techniques appreciated in the art, such as standard coin photography, laser imaging, computer imaging, biometrics, and even mechanical scanning, and the coin image may be stored by any of a number of adequate data database storage means known in the art, including any functional type of computer hard drives located internally, externally, on disk, on tape, and stored in in-house or remote image storage depositories or hard drives. The images can be retrieved for comparative or display purposes at any time. By 'comparative', the inventor intends to mean that one or more coin images, created in any one or more points in time, may be compared to one or more secondary images of that same coin specimen, imaged at another point in time. Alternatively, the invention also considers that one first coin image may be compared to an image of a second coin, or even more. The "CP16 CoinAnalyzer" (purchased from CoinSecure, Inc., of Mountain View, Calif.) is one example of a preferred device that may be used to scan and image a coin's surfaces and secure the surface characteristics of that coin in an electronic database for future temporal retrieval and analysis, and may serve as one or more steps in the manner by which determining and labeling the eye appeal of a coin may be effectuated.

Furthermore, as the eye appeal of a coin is determined and stored, the labeling of an eye appeal designation on a coin holder or container of such coin in a manner such that said eye appeal rating of that coin is displayed to a viewer of the coin in that container may be achieved in a number of different ways which can be understood by those of skill in the relevant arts. Some examples of optical-related technology are contemplated herein for use in present embodiment as elements and manners in which a coin may be imaged and stored for security-related purposes.

The coin is then slabbed/re-slabbed and returned to the owner/submitter. The crucial part of the preservation safeguard system relates to the continued re-evaluation of the coin's AURA over time adds a level of security. Although a coin can be re-evaluated at any time interval deemed appropriate by a certification company, doctored coins can degrade substantially in as little as a year; consequently, the evaluation of a coin every one or two years, for example, can be appropriate. After the specified interval of time has passed, the coin is again submitted to the certification company that in turn re-evaluates and rates its AURA and photographs it once more. This process constitutes a 'check-up' on the coin that allows the certification company to ensure that the coin is maintaining its initial eye appeal and, by extension, has not been doctored.

Coin owners benefit from a preservation safeguard system involving regular coin check-ups because it helps them document and demonstrate a coin's continued quality and value in the coin market and for insurance purposes. For certification companies, which not only grade a coin but also guarantee its authenticity, the preservation safeguard system represents an opportunity for them to keep track of the eye appeal of coins over time and potentially identify the source(s) (e.g., owners, submitters) of coins that, with consistency and/or regularity degrade or turn after slabbing, assumedly due to coin doctoring. Thus, with the likelihood of being caught increased several-fold through the use of the preservation safeguard system, many coin doctors will receive a disincentive from perpetrate coin tampering. Importantly, this AURA-based evaluation system may decrease coin doctoring activity, likely reducing the liability of coin certification companies, and thus significantly lowering the company's insurance costs.

Thus, the coin industry can benefit from many new embodiments of the present invention, including but not limited to periodic coin grading eye appeal 'checks' and AURA re-grades, judging eye appeal and offering AURA ratings after a coin has been in the holder for a certain period of time; coating coins with an inert substances upon slabbing to ensure that eye appeal remains unchanged, dating to time in which a certain AURA eye appeal rating is made. It is believed that the present invention in its many embodiment will thus be of great benefit to coin buyers and reputable dealers alike in that coin markets (like stocks or other tangible assets) change all the while, so a coin's eye appeal changing, from the dated time, is an excepted and calculated risk of buying, and can be monitored with more precision, as well as the industry wide effort to shut down the coin doctors (using the systems and related embodiments mentioned in this patent) can be achieved over time.

Thus, coins can be given a Sheldon scale grade, as it historically has been given, but with the addition of an AURA rating grade, as well, which the inventor believes will some of the guess work out of the present market grading predicament within the industry. The system quantifies, and by extension, qualifies coin value. This new AURA rating system will therefore foster a 'sight-unseen' coin purchasing transaction system that is more precise than the present grading and transaction systems, and allow the industry to move forward.

Those of skill in the art will realize that the present invention may be practiced for increased market certainty using various alternatives embodiments, including, but not limited to computerized grading, coin recognition software, fractional and two sided grades, counterfeit holder detectors, radio frequency identification chips, coin exchange markets (like commodities and stocks), acceptance of numismatic holding in 401Ks and other retirement plans, accurate insurance coverage for numismatic holdings (somewhat in line with the certainty strived for in other industries, including those involving precious gemstones and art).

What is claimed is:

1. A coin value preservation and safeguard holder display method adapted to increase coin grading precision within the conventional Sheldon coin grading standard and further safeguard the condition of an uncirculated coin through the introduction and display of one or more eye appeal-related information indicators, comprising: a) providing an uncirculated coin, said coin i) having been fractionally graded within one whole number in the numerical 60-70 range within the conventional Sheldon whole number scale; and ii) said coin having been further digitally imaged, whereby said digital coin image file is electronically stored in a database for future comparative assessment with a second digital coin image file of said coin created at a later date; b) including a standard clear plastic coin holder display device capable of displaying a coin label in proximity to said related uncirculated coin; and c) introducing and displaying said coin label, said label being internally-affixed within said coin holder display device and further capable of displaying at least one eye appeal-related information indicator associated with said uncirculated coin, whereas said at least one eye appeal-related information indicator comprises a plus ("+") symbol printed on said label defined within said display device, said + symbol adjoining the coin's Sheldon whole number grade on said label, and further being located on said label in proximity to said coin such that the indicator is openly displayed, said indicator further correlating to a precise above-average fractional grade condition of said coin.

2. A coin holder display method of claim 1, wherein a first label indicator further comprises a plus ("+") symbol label indicator adjoining said Sheldon whole number labeled grade, said + symbol further being positioned and displayed to indicate that at least one characteristic of the graded coin was pre-determined to be in an above-average condition based partially on the eye appeal of that coin, and wherein a second label indicator further comprises a gold art symbol label indicator positioned on said label, wherein said gold indicator is capable of displaying to a viewer, and indicates that at least one electronic image file of the graded coin contained within the holder has been digitally recorded and maintained in a standard computer digital image file database that allows for future comparative assessment of said first electronic image file with a second electronic image file of the same coin at one or more points in time.

3. A method of claim 1 for displaying at least one visual indicator associated with an uncirculated coin by using a coin label situated within an appropriate holder, comprising visually including therewith, and arranged in a manner such that an eye appeal-related indicator associated with said coin comprises a QUERTY plus (+) symbol such as to indicate that said uncirculated coin's eye appeal condition is predetermined to be of above average quality within its Sheldon scale whole number grade, and the preservation safeguard-related indicator associated with said coin comprises a colored label such as to indicate that the uncirculated coin was imaged beforehand using a conventional digital image recording device, and that the imaged coin's digital file is stored in a computer database for future comparative purposes.

4. A coin value preservation and safeguard holder display of claim 1, wherein said holder is capable of displaying one or more labeling indicators that are located in proximity to a graded coin contained within said holder, said holder comprising a graded coin and an internal grading label, said grading label including a first plus ("+") symbol grading indicator capable of displaying to the viewer that the graded coin has been graded using a fractional increment grading scale and found to have above-average eye appeal within the further displayed standard Sheldon scale whole number grade being displayed on the label, said above-average eye appeal condition being based on one or more characteristics of the graded coin, and said label further comprising a second colored symbol label indicator capable of displaying to a viewer that at least one electronic image file of the graded coin displayed within the holder has been previously recorded and said file is as a first file maintained in a standard computer digital file database that allows for future comparative assessment of the first file to a second digital file.

5. A display method of claim 1 for indicating the above-average eye appeal-related quality and preservation safeguard information of an uncirculated coin, comprising visually including therewith, in a manner such to display said above-average quality eye appeal-related quality associated with said coin, a plus ("+") symbol indicating at least partially the above-average eye appeal-related quality of said coin, and a gold color label decal indicating the preservation safeguard information associated with said coin.

* * * * *

US008661889C1

(12) EX PARTE REEXAMINATION CERTIFICATE (10627th)

United States Patent
Blake

(10) Number: US 8,661,889 C1
(45) Certificate Issued: Jun. 9, 2015

(54) AURA DEVICES AND METHODS FOR INCREASING RARE COIN VALUE

(75) Inventor: Duane C. Blake, Westwood, MA (US)

(73) Assignee: CERTIFIED COLLECTIBLES GROUP LLC, Sarasota, FL (US)

Reexamination Request:
No. 90/013,320, Nov. 20, 2014

Reexamination Certificate for:

| | |
|---|---|
| Patent No.: | **8,661,889** |
| Issued: | **Mar. 4, 2014** |
| Appl. No.: | **12/804,141** |
| Filed: | **Jul. 14, 2010** |

Related U.S. Application Data

(60) Provisional application No. 61/226,263, filed on Jul. 16, 2009.

(51) Int. Cl.
*G07D 5/00* (2006.01)

(52) U.S. Cl.
CPC ..... *G07D 5/00* (2013.01)

(58) Field of Classification Search
None
See application file for complete search history.

(56) References Cited

To view the complete listing of prior art documents cited during the proceeding for Reexamination Control Number 90/013,320, please refer to the USPTO's public Patent Application Information Retrieval (PAIR) system under the Display References tab.

*Primary Examiner* — Margaret Rubin

(57) ABSTRACT

The present invention relates to coin value safeguard devices and methods by determining and monitoring the eye appeal of a coin and labeling that eye appeal on an appropriate holder of the coin such that the eye appeal is displayed to a viewer of the holder, and that coin's value is thus increased. Appropriately knowledgeable graders assess a coin's eye appeal by determining the coin's axial ultimate refractory angle(s) (AURA) and assigning an AURA rating to the coin. The coin image is stored in a database where it may be compared to secondary temporal images of the coin as necessary to determine whether coin doctoring has been employed.

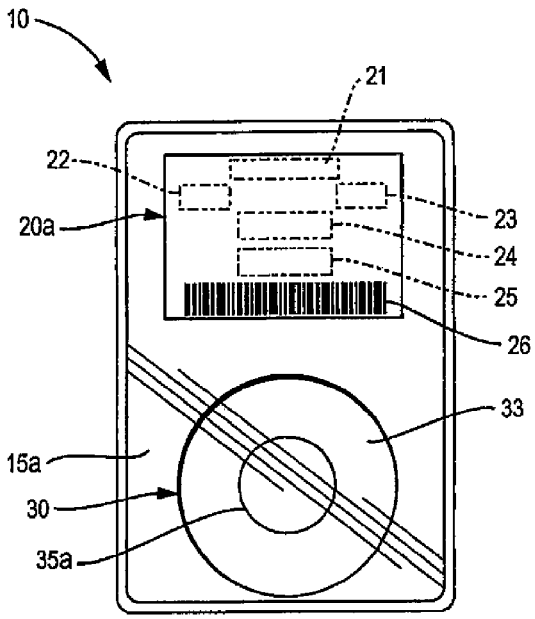

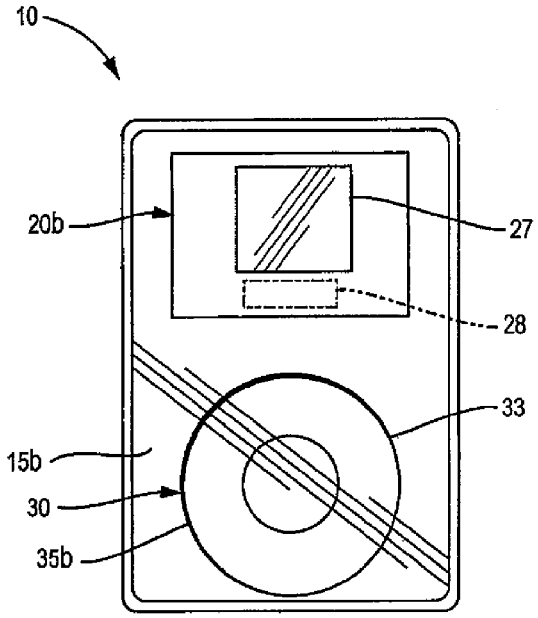

©2008 Duane C. Blake

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-5 is confirmed.

* * * * *